United States Patent [19]

Volk

[11] Patent Number: 4,679,878

[45] Date of Patent: Jul. 14, 1987

[54] INSULATION-PIERCING ELECTRICAL CONTACT AND CONNECTOR INCORPORATING THE SAME

[75] Inventor: Claus Volk, Yorktown Heights, N.Y.

[73] Assignee: Stewart Stamping Corporation, Yonkers, N.Y.

[21] Appl. No.: 761,477

[22] Filed: Aug. 1, 1985

[51] Int. Cl.[4] ..... H01R 4/24

[52] U.S. Cl. ..... 439/425

[58] Field of Search ..... 339/97 R, 97 P, 99 R, 339/98

[56] References Cited

U.S. PATENT DOCUMENTS

| | | | |
|---|---|---|---|
| 3,816,818 | 6/1974 | Meier | 339/99 R |
| 3,860,316 | 1/1975 | Hardesty | 339/99 R |
| 4,089,580 | 5/1978 | Huffnagle et al. | 339/99 R |
| 4,211,462 | 7/1980 | Wolfthal | 339/99 R |
| 4,270,831 | 6/1981 | Takahashi | 339/97 C |
| 4,431,246 | 2/1984 | Vaden | 339/97 R |

FOREIGN PATENT DOCUMENTS

| | | | |
|---|---|---|---|
| 2455354 | 5/1975 | Fed. Rep. of Germany | 339/99 R |
| 2542219 | 3/1977 | Fed. Rep. of Germany | 339/99 R |

*Primary Examiner*—Gil Weidenfeld
*Assistant Examiner*—Gary F. Paumen
*Attorney, Agent, or Firm*—Steinberg & Raskin

[57] ABSTRACT

An insulation-piercing contact for terminating solid or stranded conductors in a modular plug connector, includes a flat body portion and first and second longitudinally spaced insulation-piercing tines, each of which has an inner surface adapted to electrically engage a respective conductor situated in a corresponding channel formed in the connector housing. The tines are transversely offset with respect to each other so that their inner surfaces are mutually spaced in a transverse plane through the contact a distance less than the maximum transverse dimension of the conductor. The distance between the inner surface of each tine end and an opposed partition wall of a respective channel in the modular plug connector housing in which the conductor is situated is preferably less than the sum of the diameter of the conductor and the thickness of the insulation surrounding the same.

4 Claims, 6 Drawing Figures

INSULATION-PIERCING ELECTRICAL CONTACT AND CONNECTOR INCORPORATING THE SAME

BACKGROUND OF THE INVENTION

This invention relates generally to insulation-piercing electrical contacts and connectors incorporating such contacts and, more particularly, to insulation-piercing electrical contacts for use in modular plug connectors and to modular plug connectors incorporating such insulation-piercing electrical contacts.

Modular plug connectors are widely used in the telephone and data communication fields to terminate flat multi-conductor cables including a plurality of insulated conductors arranged in a spaced linear array within an outer jacket. Examples of such connectors are disclosed in U.S. Pat. Nos. 3,860,316 to Hardesty and 4,211,462 to Wolfthal.

After removing the end portion of the cable outer jacket, the exposed insulated conductors are inserted into adjacent channels formed in the connector housing, whereupon a plurality of flat contacts corresponding in number to the number of conductors in the cable are inserted into respective slots formed in the connector housing aligned with respective channels in which the insulated conductors are situated. Each contact has a pair of blades which pierce the insulation of a corresponding conductor and the conductor itself, which is conventionally formed of soft tinsel material, to thereby provide a solderless electrical connection. Each contact has a flat top edge surface adapted to electrically engage a respective jack contact when the plug connector is inserted into a jack receptacle.

It would be desirable to use solid or stranded conductors in the multi-conductor cables in lieu of the soft tinsel conductors since tinsel material is relatively expensive and easily broken. However, since solid or stranded conductors are relatively hard, it is generally not possible to use the conductor-piercing contact described above with such conductor material. It would therefore be desirable to provide a contact which could be used with solid or stranded conductors.

Several contact constructions for terminating solid or stranded conductors have been suggested. For example, reference is made to U.S. Pat. Nos. 3,816,818 to Meier, 4,089,580 to Huffnagle, 4,270,831 to Takahashi and 4,431,246 to Vaden.

The Meier '818 patent discloses a contact for use in a non-modular type connector, including two end insulation-piercing tines and an intermediate insulation-piercing tine which are longitudinally spaced from each other in transversely offset pattern with respect to the longitudinal axis of the cable conductors. The contact is formed so that upon termination the inner surfaces of the end tines will lie adjacent to and electrically engage one side of the solid conductor while the inner surface of the intermediate tine will lie adjacent to and electrically engage the other side of the solid conductor.

The Huffnagle '580 patent discloses a contact for use in a non-modular type connector for terminating a non-insulated solid conductor. The contact includes two end arms and an intermediate arm which are longitudinally spaced from each other in a transversely offset pattern. Each of the arms has a concave configuration so that when a conductor is pressed into the spaces between the contact arms, it engages the opposed corner edges of the arms between adjacent arms.

The Takahashi '831 patent discloses a contact for use in a non-modular type connector which includes a first angular tine, a second angular tine oppositely disposed at the same angle as that of the first tine, and a third tine disposed at a different angle from that of the first and second tines so that the center thereof is on the lateral centerline of the space between the tines. The tines define press-in openings between their corner edges for connection to a solid conductor.

The Vaden '246 patent discloses a contact for use in a modular type connector including first and second adjacent insulation-piercing tines which are situated next to each other without any longitudinal space between them. The tines are adapted to bend or flare laterally outwardly in opposite directions when the conductor is terminated to provide a sort of crimped electrical connection.

It is important to obtain an electrical connection between the contact and conductor which is as reliable as possible. The construction of modular plug connectors presents certain limitations which should be taken into account in the design of the contact so that conventional contacts designed for use in non-modular connectors are not always suitable. Moreover, conventional contacts designed for modular plug connectors are not entirely satisfactory. For example, in the case of the contact described in the Vaden '246 patent, it is not uncommon for a tine which engages one conductor to pierce the partition wall separating adjacent conductor-receiving channels of the modular plug connector and pass into the adjacent channel as it bends outwardly and thereby engage an adjacent conductor. This of course, results in a defective connector.

SUMMARY OF THE INVENTION

Accordingly, one object of the present invention is to provide a new and improved contact for use in a modular plug connector.

Another object of the present invention is to provide a new and improved contact for use in a modular plug connector for terminating solid or stranded conductors.

Still another object of the present invention is to provide a new and improved contact for use in a modular plug connector which provides a reliable electrical connection and which eliminates the drawbacks of conventional contacts.

A further object of the present invention is to provide a new and improved modular plug connector incorporating an insulation-piercing contact which satisfies the above-described objects.

Briefly, in accordance with the present invention, these and other objects are obtained by providing an insulation-piercing contact which is specifically designed for terminating solid or stranded conductors in a modular plug connector. Such contacts are inserted through slots into respective longitudinal conductor-receiving channels formed in the housing of the modular plug connector which are separated from each other by partition walls. The channels have a width which is substantially equal to or slightly larger than the diameter of the insulated conductors received therein. It is noted that the term "insulated conductor" as used herein means the metallic conductor covered by insulation while the term "conductor" refers to the metallic conductor itself.

In accordance with the invention, the contact includes a thin, substantially planar or flat body portion and first and second insulation-piercing tines which are longitudinally spaced from each other. Each of the tines has an inner surface adapted to electrically engage the elongated conductor. The tines are transversely offset with respect to each other so that their inner surfaces are spaced from each other in a transverse plane passing through the contact a distance less than the maximum transverse dimension (i.e., the diameter) of the elongated conductor. The distance between the inner surface of each tine and the opposed partition wall of the channel in which the conductor is received is less than the sum of the diameter of the conductor and the thickness of the surrounding insulation.

As each contact is inserted into a respective channel through a communicating slot, the tines pierce the insulation and engage opposite sides of the conductor at longitudinally spaced regions thereof. At the same time, the engaged regions of the conductors are urged or displaced in opposite transverse directions and squeezed against a respective one of the channel partition walls with a thickness of insulation being compressed therebetween. The bottom edges of the tines penetrate into the plastic of the bottom wall of the channel to securely hold the tines in position.

The conductors and tines are thereby reliably held in mutual engagement under the forces of the compressed insulation which exerts a continuous restoring force against the conductors which tends to maintain the conductors in positive electrical engagement with the inner surfaces of the respective tines.

The tines are preferably formed so that although they are transversely offset to an extent such that a substantial portion of their thickness lies outside the thickness of the body portion of the contact. At least portions of the bottom edges of the tines lie within the thickness of the contact body portion to insure that the tines will not bend or flare outwardly during termination, i.e., to provide structural rigidity to the assembly. The inner surfaces of the tines preferably include lower vertical portions and upper angular portions, the latter of which engage the longitudinally spaced regions of the conductors to facilitate the transverse displacement of them towards the respective partition walls.

DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENT

Figure 1:
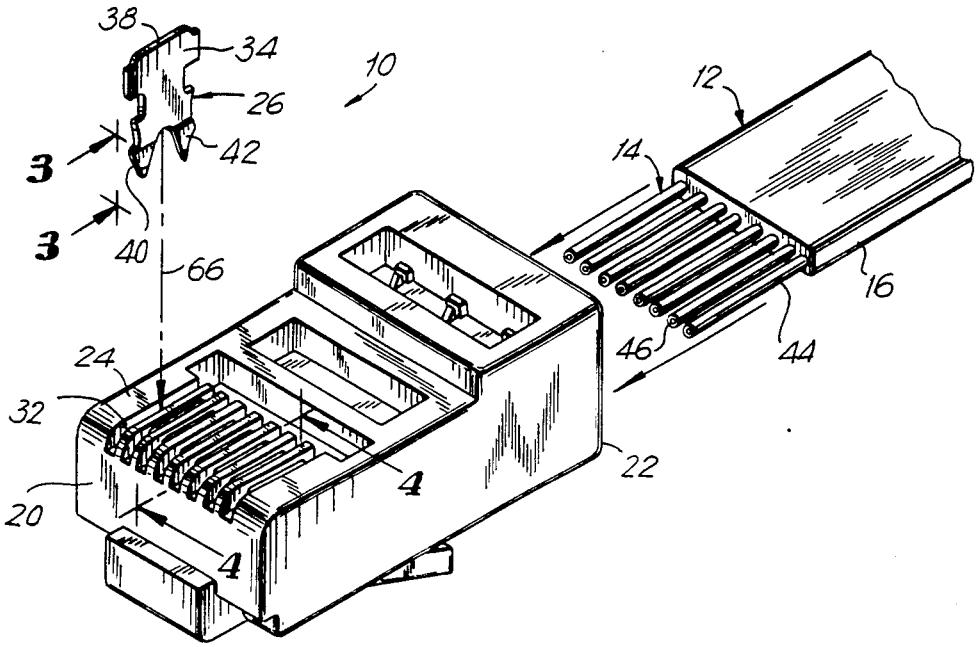
FIG. 1 is a perspective view of a modular plug connector and associated multi-conductor cable and illustrating the insertion of a contact in accordance with the present invention.
Figure 2:
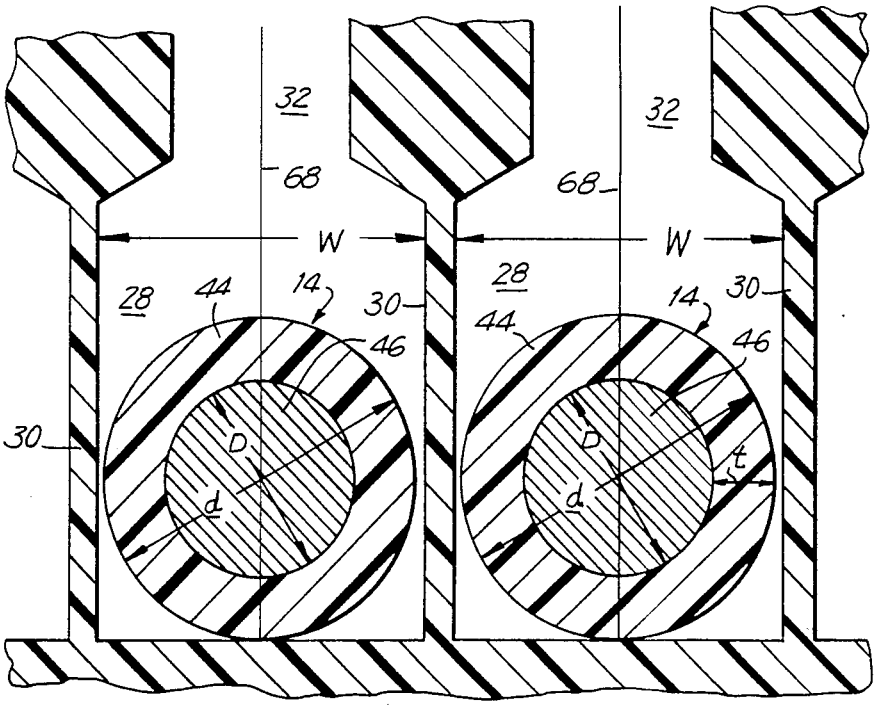
FIG. 2 is a transverse section view of an insulated conductors of the cable in FIG. 1 situated within conductor-receiving channels of the modular plug connector.
Figure 4:
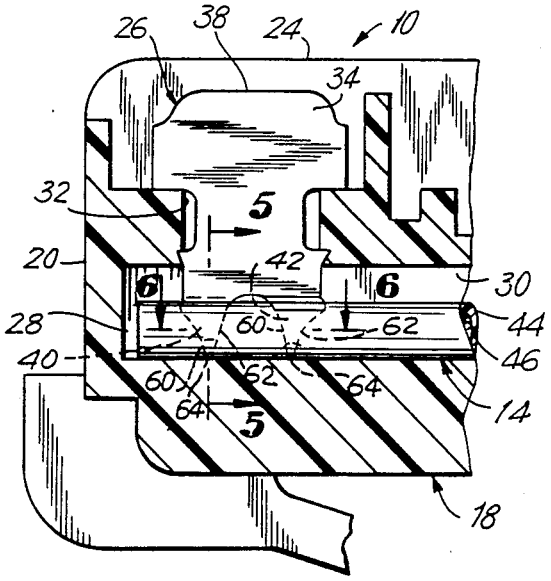
FIG. 4 is a longitudinal section view of a conductor terminated by a contact in accordance with the invention taken along line 4—4 of FIG. 1.

Referring now to the drawings wherein like reference characters designate identical or corresponding parts throughout the several views, and more particularly to FIGS. 1, 2 and 4, a conventional modular plug connector 10 is illustrated adapted to terminate a flat multi-conductor cable 12. The cable 12 includes eight insulated conductors 14 surrounded by a plastic jacket or sheath 16, although it is understood that the invention may be used to terminate cables having different configurations.

The housing 18 of modular plug connector 10 is essentially of conventional construction. In this connection, reference is made to the description of the construction of the housing in U.S. Pat. No. 4,211,462 of Wolfthal, incorporated by reference herein. Briefly, the connector 10 includes a rigid, dieletric unipartite housing 18 formed of plastic material, such as polycarbonate, by conventional injection molding techniques. The housing 18 has a closed forward end 20, a cable-receiving rearward end 22 and a contact-receiving side 24.

A plurality of longitudinally extending parallel channels 28 are formed through the forward end portion of housing 18 communicating with a cable-receiving opening formed in the cable-receiving rearward end 22 for receiving end portions of respective ones of the insulated conductors 14 from which the sheath 16 has been removed as seen in FIG. 1. As seen in FIG. 2, each channel 28 has a width W which is substantially equal to or slightly greater than the diameter D of the insulated conductor 14 received therein. Adjacent channels are separated from each other by vertical partition walls 30. Individual slots 32 opening onto the contact-receiving side 24 of housing 18 communicate with respective channels 28. The contacts 26 are inserted through corresponding slots 32 for terminating the conductors as described below.

Each contact 26 is formed of a metallic conductive material, such as phosphor bronze, and includes a thin, substantially planar or flat body portion 34 having a pair of opposed substantially planar side surfaces **36*a* and 36*b* and a longitudinally extending top edge surface 38 which is adapted to electrically engage a respective jack contact when the modular plug connector is inserted into the jack receptacle. First and second adjacent tines 40 and 42 extend integrally from body portion 34. The tines 40 and 42 are longitudinally spaced from each other and terminate at pointed lower edges, described below, to facilitate piercing of the insulation 44 upon the termination of conductors 46 of the insulated conductors 14. The conductors 46 are shown as solid but it is understood that they may be stranded or of other construction. Thus, the tines 40 and 42 of each contact 26 are adapted to pierce the insulation 44 of a respective one of the insulated conductors 14 situated within a respective channel 28**.

Figure 3:
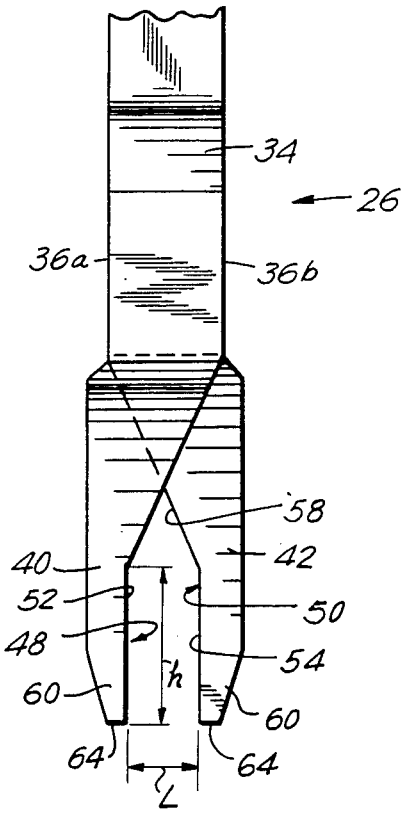
FIG. 3 is a partial view of a contact in accordance with the invention in the direction of line 3—3 of FIG. 1.

First and second tines 40 and 42 are transversely offset with respect to each other as best seen in FIG. 3 in a manner such that each tine 40, 42 has an inner surface 48, 50 respectively, which is adapted to electrically engage a respective side of a corresponding side of a conductor 46 as described below. The tines are transversely offset to an extent such that a substantial portion of their thickness lies outside the thickness of the body portion 34. However, the inner surfaces 48, 50 of tines 40, 42 preferably lie within the thickness of body portion 34 and are spaced from each other in a transverse plane passing through contact 26 a distance L (FIG. 3) which is less than the diameter d (FIG. 2) of conductor 46. Moreover, referring to FIG. 5, the transverse distance e between each of the inner surfaces 48, 50 of tines 40, 42 and the respective opposed surface of a channel partition wall 30 is preferably less than the sum of the diameter d of conductor 46 and the thickness t (FIG. 2) of insulation 44.

The inner surfaces 48, 50 of tines 40, 42 include lower, substantially vertical portions 52, 54 and upper, angled portions 56, 58. The height h (FIG. 3) of each vertical portion 52, 54 of the inner tine surface preferably is about one-half the diameter D of the insulated conductor 14 although it can be higher or lower within the scope of the invention.

Each tine 40, 42 has narrow side surfaces 60 and 62 which taper downwardly toward each other to define a sharp bottom edge 64 which, as mentioned above, facilitates piercing of the insulation. At least an inner portion of the bottom edge 64 of each tine preferably lies within the thickness of the body portion 34 of contact 26. of the body portion 34 of contact 26.

In use, after removing the end of sheath 16 from cable 12, the exposed insulated conductors 14 are inserted into respective channels 28 of the modular plug connector housing 18 as best seen in FIGS. 1 and 2. As mentioned above, the width W of the channels 28 is substantially equal to or slightly greater than the diameter D of the insulated conductors 14 so that the metallic conductors 46 substantially align with the slots 32 formed in housing 18. The contacts 26 are then inserted into respective slots 32 in the manner indicated by arrow 66 in FIG. 1.

Figure 5:
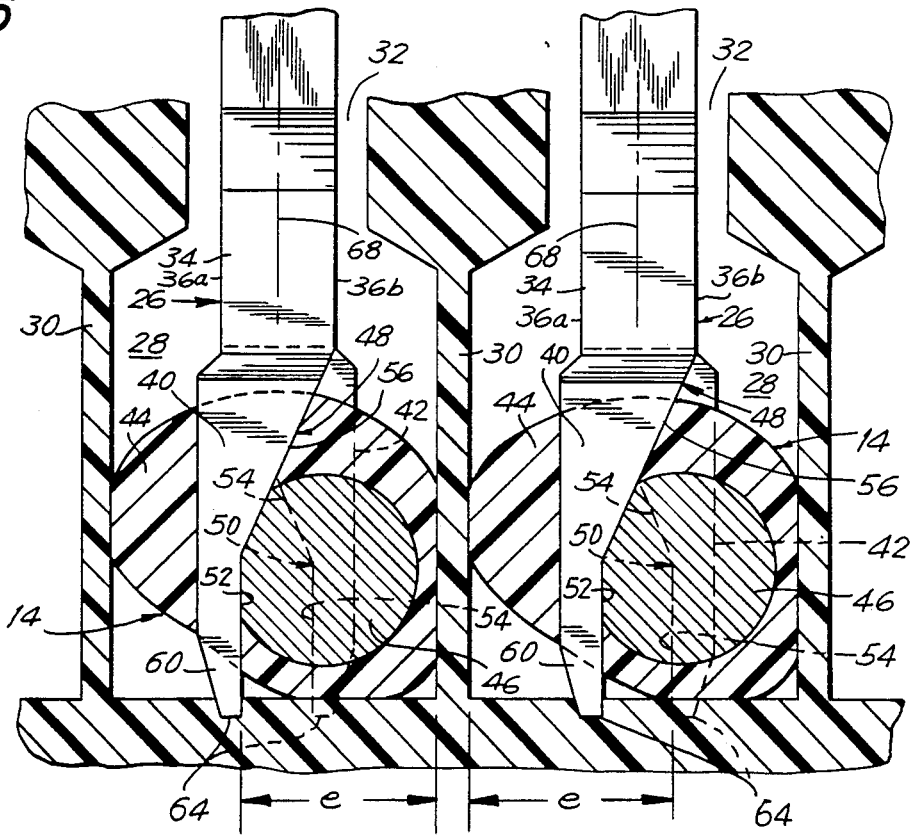
FIG. 5 is a transverse section view of the conductor terminated by the contact in accordance with the invention taken along line 5—5 of FIG. 4.
Figure 6:
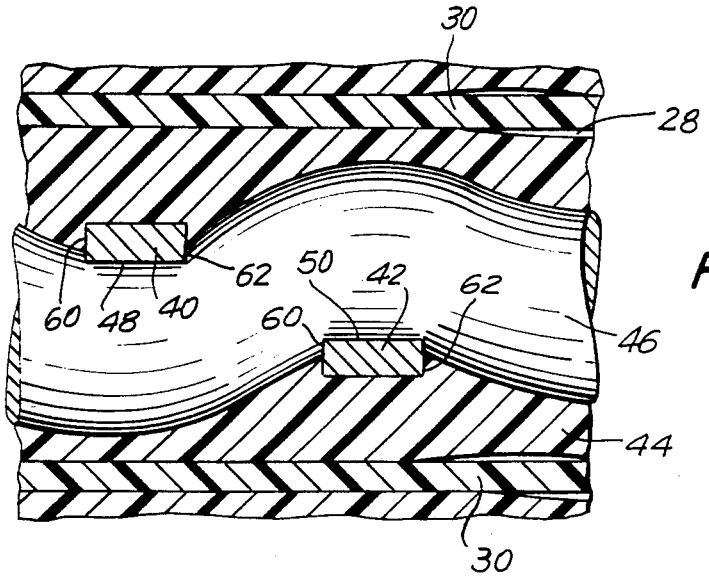
FIG. 6 is a section view taken along line 6—6 of FIG. 4.

As each contact 26 is driven in its respective slot 32, the sharp bottom edges 64 of the first and second tines 40 and 42 pierce the insulation 44 of the conductor situated in the corresponding channel 28 on opposite sides of an imaginary vertical, central plane 68 of the channel 28. As shown in FIG. 5, the first or forward tine 40 pierces the insulation 14 on the left side of plane 68 whereupon its inner surface 48 engages the surface of the conductor 46 on the left side of its vertical plane of symmetry, so that as the contact is driven further downwardly in channel 28, the portion of the length of conductor 46 engaged by the first or forward tine 40 is urged or displaced to the right as seen in FIG. 5. The upper, angled portion 56 of inner surface 48 eventually engages conductor 46 and serves to urge the conductor 46 further to the right and somewhat downwardly. In a similar manner, the second or rearward tine 42 of each contact pierces the insulation 14 on the right side of plane 68 whereupon its inner surface 50 enages the surface of the conductor 46 on the right side of its vertical plane of symmetry. In this manner the portion of the length of conductor 46 engaged by the second or rearward tine 42 is urged or displaced to the left, i.e., in an opposite direction than that in which the forward portion of the conductor is displaced as best seen in FIG. 6. The bottom edges 64 of tines 40, 42 penetrate into the bottom wall 70 of channel 28 to rigidly fix the contact in position.

Since the distance e (FIG. 5) between the vertical portions of the inner surfaces of the tines and the opposite partition walls 30 is less than the sum of the diameter d of conductor 46 and the thickness t of insulation 44, the insulation 44 is compressed between the displaced portions of the conductor and the proximate partition wall 30. The compression results in a constant force being applied by the compressed insulation against the displaced portion of the conductor which positively urges the conductor portions against the inner surfaces of the tines thereby improving the reliability of the electrical connection.

As noted above, the inner surfaces 48, 50 and at least portions of the bottom edges 64 of tines 40, 42 lie within the thickness of the body portion 34. The structural rigidity of the contact is thereby improved, i.e., the possibility of the tines buckling or bending during insertion of the contacts is eliminated. This is advantageous in that there is a danger in the case where the tines should buckle outwardly that a tine may pierce through a partition wall 30 and electrically engage a conductor in an adjacent channel thereby resulting in a defective connection.

Typical dimensions are as follows: the diameter d of conductors 46 are in the range of between about 0.0126 to 0.0253 inches. The thickness t of insulation 44 is in the range of between about 0.008 to 0.010 inches. The width W of each channel 28 is in the range of between about 0.031 to 0.037 inches. The distance L between the inner surfaces 48 and 50 of tines 40 and 41 is about 0.008 inches. The height h of the vertical inner surfaces 48 and 50 of tines 40 and 41 is about 0.015 inches. The thickness of the body portion 34 of a contact 26 is about 0.012 inches. It will be understood, however, that other dimensions may be utilized within the scope of the invention.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A modular plug connector, such as of the type insertable into modular jacks for telephone use, for terminating a multi-conductor cable comprising a plurality of elongated insulated conductors comprising:

a unipartite housing formed of dielectric material and having a forward end, a rearward end at which the cable is received and a contact-receiving side, a plurality of channels formed in said housing for receiving respective insulated conductors, each pair of adjacent channels being separated from each other by a partition wall so that the width of said channels is defined by the distance between adjacent partition walls, and a plurality of contact-receiving slots, each slot opening onto said contact-receiving side of said housing and communicating with a respective one of said conductor-receiving channels; and a plurality of electrical contacts formed of metallic conductive material for terminating the elongated insulated conductors, each contact being received in a respective one of said contact-receiving slots and including a thin, substantially planar body portion having a pair of opposed substantially planar side surfaces defining a thickness of said body portion and a longitudinally extending top edge surface, first and second insulation-piercing tines intgegral with said body portion, said tines being longitudinally spaced from each other and transversely offset with respect to each other and piercing the insulation of the elongated insulated conductor received in the respective one of said channels communicating with the respective one of said slots in which said contact is received, each of said tines having an inner surface electrically engaging the elongated conductor of the elongated insulated conductor received in said respective channel, said inner surfaces of said tines lying within the thickness of said body portion and being transversely spaced from each other a distance less than the maximum transverse dimension of the elongated conductor, said tines terminating in bottom edges at least portions of which lie within the thickness of said body portion both before and after engagement with the elongated conductor, and wherein the transverse distance between the inner surface of each tine and an opposed partition wall is less than the sum of the diameter of the conductor and the thickness of the insulation.

2. The combination of claim 1 wherein said tines terminate in sharp bottom edges.

3. The combination of claim 1 wherein said inner surfaces of said tines each include a lower portion extending substantially parallel to the planes of said side surfaces of said body portion and an upper angled portion.

4. A modular plug connector, such as of the type insertable into modular jacks for telephone use, for terminating a multi-conductor cable comprising a plurality of elongated insulated conductors comprising:

a unipartite housing formed of dielectric material and having a forward end, a rearward end at which the cable is received and a contact-receiving side, a plurality of channels formed in said housing for receiving respective insulated conductors, each pair of adjacent channels being separated from each other by a partition wall so that the width of said channels is defined by the distance between adjacent partition walls, and a plurality of contact-receiving slots, each slot opening onto said contact-receiving side of said housing and communicating with a respective one of said conductor-receiving channels; and a plurality of electrical contacts formed of metallic conductive material for terminating the elongated insulated conductors, each contact being received in a respective one of said contact-receiving slots and including a thin, substantially planar body portion having a pair of opposed substantially planar side surfaces defining a thickness of said body portion and a longitudinally extending top edge surface, first and seecond insulation-piercing tines integral with said body portion, said tines being longitudinally spaced from each other and transversely offset with respect to each other and adapted to pierce the insulation of the elongated insulated conductor to be received in the respective one of said channels communicating with the respective one of said slots in which said contact is received, each of said tines having an inner surface adapted to electrically engage the elongated conductor of the elongated insulated conductor to be received in said respective channel, said inner surfaces of said tines lying within the thickness of said body portion and being transversely spaced from each other a distance less than the maximum transverse dimension of the elongated conductor to be received in said respective channnel, said tines terminating in bottom edges at least portions of which lie within the thickness of said body portion both before and after engagement with the elongated conductor and wherein the transverse distance between the inner surface of each tine and an opposed partition wall is less than the sum of the diameter of the conductior and the thickness of the insulation of the insulated conductor to be received in said respective channel.

* * * * *